US006059621A

United States Patent [19]

Vogel

[11] Patent Number: 6,059,621

[45] Date of Patent: May 9, 2000

[54] HIGH PERFORMANCE SURFBOARD

[76] Inventor: Richard Vogel, P.O. Box 1167, Hanalei, Hi. 96714

[21] Appl. No.: 09/228,868

[22] Filed: Jan. 12, 1999

[51] Int. Cl.[7] ..... B63B 35/79

[52] U.S. Cl. ..... 441/74; 441/79

[58] Field of Search ..... 441/65, 74, 79

[56] References Cited

U.S. PATENT DOCUMENTS

| | | | |
|---|---|---|---|
| D. 55,079 | 5/1920 | Ranlett . | |
| D. 334,419 | 3/1993 | Klein . | |
| D. 392,710 | 3/1998 | del Paso . | |
| 1,608,000 | 11/1926 | Ranlett . | |
| 3,988,794 | 11/1976 | Tinkler et al. . | |
| 4,493,665 | 1/1985 | Liddle . | |
| 4,995,631 | 2/1991 | Hunter . | |
| 4,995,843 | 2/1991 | Englemann . | |
| 5,018,760 | 5/1991 | Remondet . | |
| 5,152,705 | 10/1992 | Rock | 441/74 |
| 5,273,472 | 12/1993 | Skedeleski et al. . | |
| 5,649,846 | 7/1997 | Harper et al. . | |
| 5,683,280 | 11/1997 | Winner . | |

OTHER PUBLICATIONS

"Surfboards and Broadbill Swordfish: New Designs Based on the Hydro–Calculus of the World's Fastest Swimming Creature", Richard Vogel, Groundswell Society Annual Publication, 1997, pp. 52–65.

*Primary Examiner*—Stephen Avila
*Attorney, Agent, or Firm*—Loeb & Loeb LLP

[57] ABSTRACT

A surfboard having opposed side edges disposed symmetrically about a longitudinal centerline, the surfboard including a tail section, the side edges of the surfboard along said tail section defining a generally hourglass configuration with the contours of tail section side edges approximately hyperbolic curves. In one specific embodiment, the side edges of the tail section approximate the left- and right-hand branches of a hyperbola centered on an origin lying on said longitudinal centerline. According to another aspect of the invention, the surfboard includes a pair of side fins and a tail fin attached to the bottom surface of the board. The side fins are symmetrically disposed relative to the longitudinal centerline and are so oriented that the center planes of the side fins pass through the foci of the hyperbolic side edges of the tail section.

14 Claims, 3 Drawing Sheets

HIGH PERFORMANCE SURFBOARD

BACKGROUND OF THE INVENTION

1. Field of the Invention

The present invention relates generally to surfboards and similar aquafoils configured to provide superior stability and maneuverability.

2. Description of the Prior Art

A technical article by the present inventor, "Surfboards and Broadbill Swordfish: New Designs Based on the Hydro-Calculus Of The World's Fastest Swimming Creature," Groundswell Society Annual Publication, 1997, pp. 52–65, describes surfboard designs based on studies of specimens of the broadbill swordfish. These designs, applied to both shortboards and longboards, incorporate a tri-fin system which enhances performance in terms of overall maneuverability and stability throughout a broad range of wave conditions.

Also, surfboards with inwardly curved side edges have been known for many years, as shown, for example, by U.S. Design Pat. No. 55,079 and U.S. Pat. No. 1,608,000, both issued in the 1920's. Other surfboards of this type are disclosed in the inventor's article mentioned above. Also known are surfboards having tail notches centered on the longitudinal centerline of the board. Examples of such designs are also shown in the foregoing article and their purpose is to increase stability and maneuverability.

SUMMARY OF THE INVENTION

In accordance with one aspect of the present invention, further improvements in surfboard design and performance are provided through the careful contouring of the side edges of the tail section of the surfboard. In accordance with another aspect of the invention, surfboard performance is still further enhanced by means of side fins positioned and oriented in a specific geometric relationship with the contoured side edges of the tail section.

Pursuant to one specific exemplary embodiment of the invention, there is provided a surfboard having a longitudinal centerline and opposed side edges disposed substantially symmetrically about the centerline. The surfboard includes a tail section, the side edges of the surfboard along the tail section defining a generally hourglass configuration. More specifically, the curvatures of the side edges along the tail section are hyperbolic.

In accordance with another specific embodiment, the curvatures of the side edges of the tail section approximate the left- and right-hand branches of a hyperbola centered on an origin lying on the longitudinal centerline, each of the branches of the hyperbola having a focus.

The surfboard of the invention may further include a pair of side fins projecting from the bottom surface of said surfboard, the side fins being disposed symmetrically relative to the longitudinal centerline. Each of the side fins has a central plane oriented relative to the longitudinal centerline so that the center plane of the fin intersects the focus of the associated hyperbolic side edge.

BRIEF DESCRIPTION OF THE DRAWINGS

Further objects, features and advantages of the invention will become evident from the detailed description of the invention, below when read in conjunction with the accompanying drawings in which.

DETAILED DESCRIPTION OF THE PREFERRED EMBODIMENTS

The following describes preferred embodiments of the invention representing the best modes contemplated for practicing the invention. This description is not to be taken in a limiting sense but is made merely for the purpose of describing the general principles of the invention whose scope is defined by the appended claims.

Figure 1:
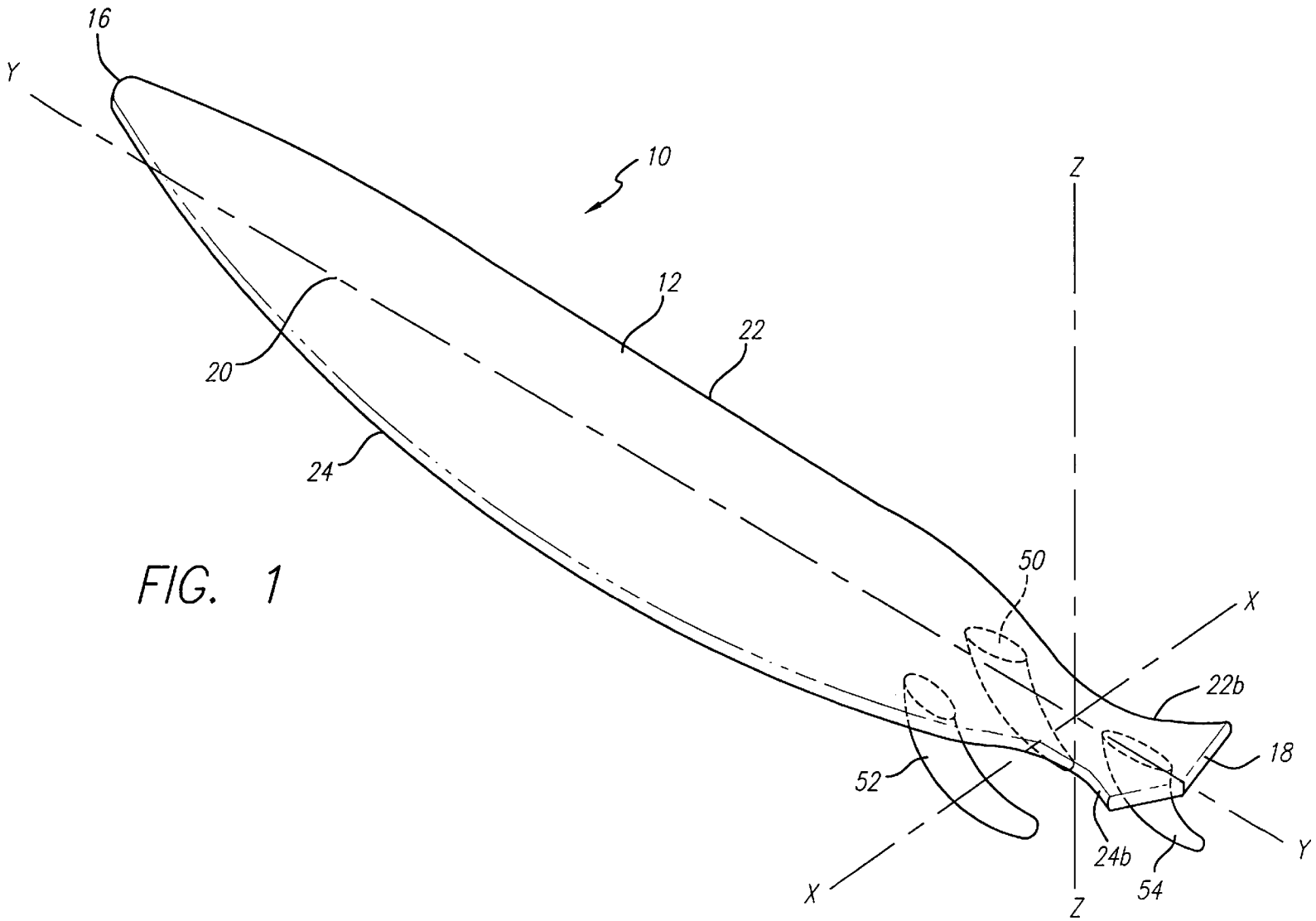
FIG. 1 is a perspective view of a surfboard in accordance with a preferred embodiment of the invention.
Figure 2:
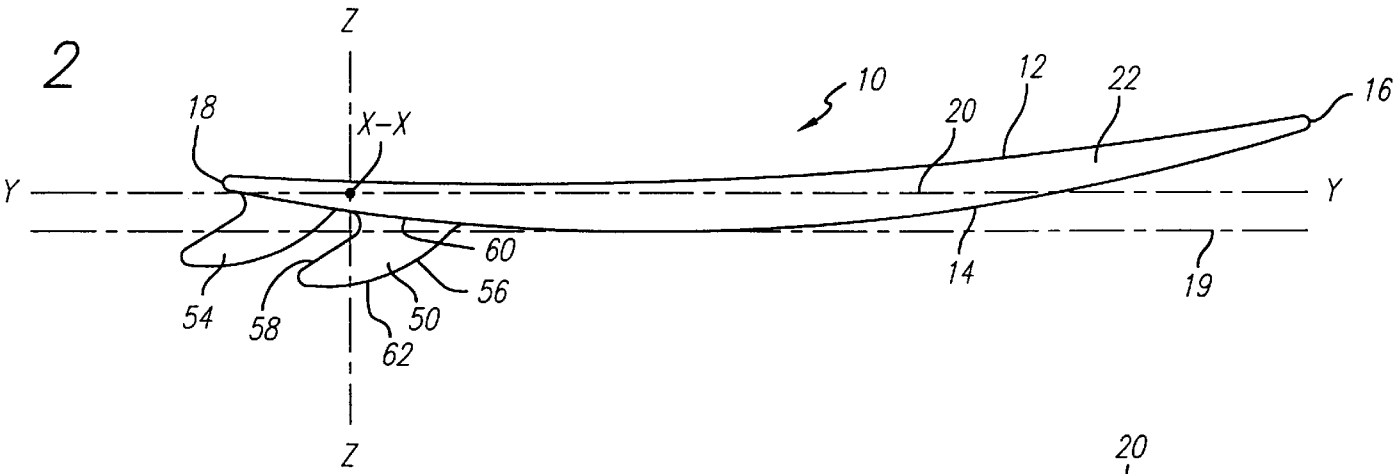
FIG. 2 is a side elevation view of the surfboard shown in FIG. 1.

Referring to the drawings, there is shown a surfboard 10 in accordance with one exemplary embodiment of the invention. The board 10 includes a top surface 12, a bottom surface 14, a front extremity or nose 16, and a transverse rear extremity or tail 18. Although the drawings show a "shortboard" having a length of about 6 feet by way of example, it will become evident from the ensuing description that the invention is equally applicable to "longboards". Further in accordance with known surfboard design techniques the board 10 may be cambered, as shown in FIG. 2, so that the nose 16 and tail 18 lie above a lower tangent plane 19 by, for example, 8 inches and 2 inches, respectively. The board 10 also has a thickness profile which may vary, for example, from ½ inch at the nose to about 3 ½ inches at the thickest point to about ⅞ inch at the tail.

The surfboard 10 includes a longitudinal centerline 20 extending from the nose 16 to the tail 18, the centerline coinciding with an axis which will be referred to as the y-axis. The surfboard 10 further includes curved side edges 22 and 24 symmetrically disposed relative to the longitudinal centerline 20. To facilitate the description of the invention, the board 10 may be divided into a forward section 26, an aft or tail section 28 and a transition section 30 joining the sections 26 and 28. The side edge portions 22*a* and 24*a* of the forward section 26 may be curved in accordance with well-known geometries. The side edge portions 22*b* and 24*b* of the tail section 28 of the board define a generally hourglass configuration, that is, proceeding in a direction from nose to tail, the side edge portions 22*b*, 24*b* along the tail section 28 curve inwardly toward, and then outwardly away from, the longitudinal centerline 20. The side edge portions 22*a*, 24*a* of the forward section 26 and the side edge portions 22*b*, 24*b* of the tail section 28 blend into each other along the side edge portions 22*c* and 24*c* of the transition section 30.

Figure 5:
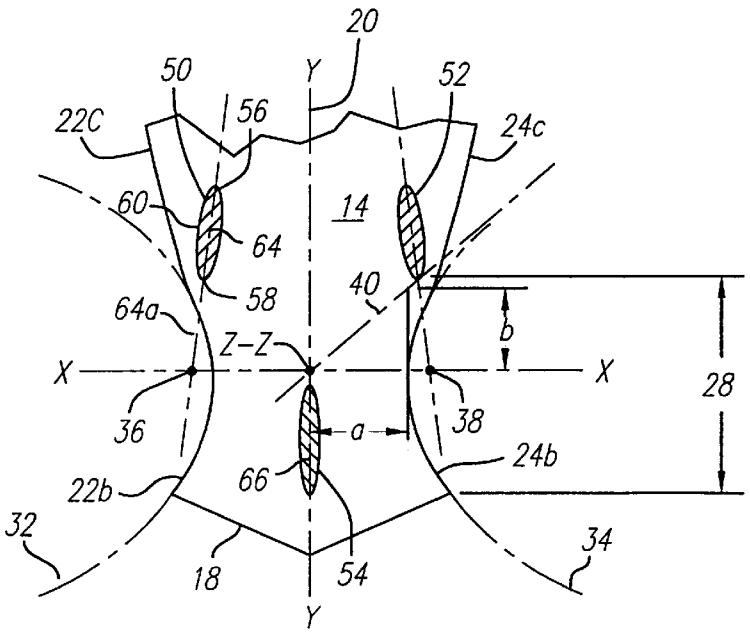
FIG. 5 is plan view of the tail section of the surfboard of FIG. 1.
Figure 3:
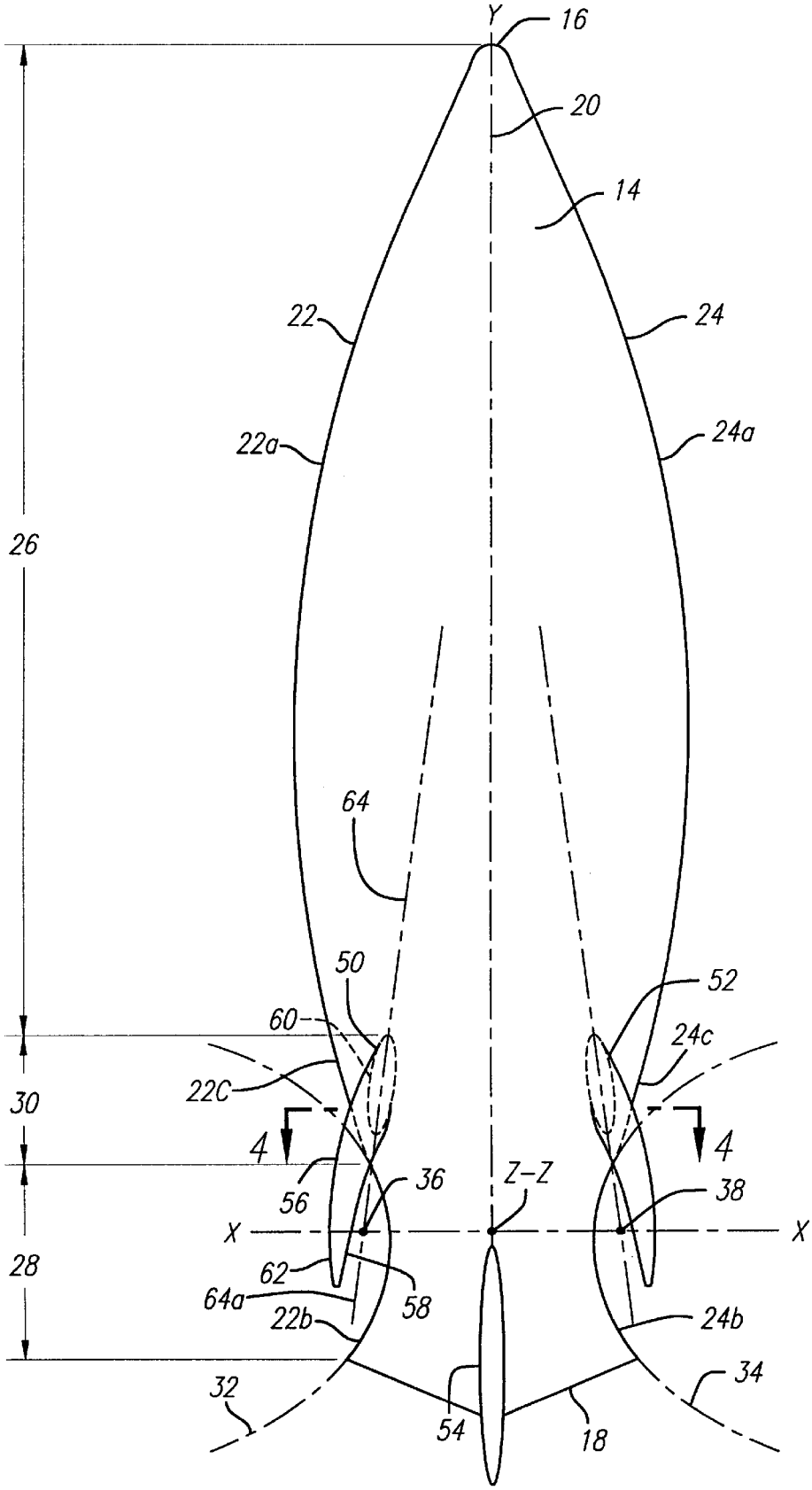
FIG. 3 is a bottom plan view of the surfboard of FIG. 1.

In accordance with one aspect of the present invention, the side edge portions 22*b*, 24*b* of the tail section 28 conform substantially to hyperbolic curves 32 and 34, respectively, positioned symmetrically about an x-axis perpendicular to the y-axis. As seen in FIGS. 3 and 5, the hyperbolic curves 32 and 34 have foci 36 and 38, respectively, lying on the x-axis outboard of each of the side edge portions 22*b*, 24*b* of the tail section 28.

In accordance with another exemplary embodiment of the invention, the curves 32 and 34 are defined by the left-hand and right-hand branches of a hyperbola having its center at the origin, that is, at the intersection of the x-and y-axes (the principal axes).

Such a hyperbola conforms to an equation of the form:

$$y=\pm b/a\sqrt{x^2-a^2}$$

where a is the distance along the x-axis from the origin to the nearest point on the hyperbola, and b is the distance in a direction parallel with the y-axis from the point at which the hyperbola intersects the x-axis to an asymptote 40.

In accordance with yet another specific exemplary embodiment of the invention, the parameters a and b in the foregoing equation are set equal, in which case the curve is an equilateral hyperbola.

In accordance with one specific, practical example, a shortboard pursuant to the invention may be about 6 feet in length, have a width at its widest point of about 20 inches, a width of about 10 inches along the x-axis and a width of about 15 inches across the tail.

Attached to the bottom surface 14 of the surfboard 10 and extending downwardly therefrom is a system of three fins including a pair of side fins 50 and 52, one on each side of the centerline 20, and a tail fin 54 adjacent the tail 18. The first and second fins 50 and 52 are disposed symmetrically of the centerline 20, that is, equidistant from that line. The advantages of such a "tri-fin" system are described in the inventor's technical article referred to above. The tail fin 54 of the tri-fin system shown and described provides for an especially stable surfboard in large waves. As an alternative, for superior performance in small wave conditions, the tail fin 54 may be eliminated leaving only the side fins 50 and 52. To achieve the high performance made possible by the present invention, the side fins of such a twin fin board should be oriented relative to the foci 36 and 38 as described herein.

As best seen in FIGS. 3 and 5, the side fins 50 and 52 are attached to the bottom surface 14 in the vicinity of the transition section 30. It will be evident, however, that the side fins 50 and 52 may be mounted somewhat forwardly or rearwardly of the position shown. In accordance with the present invention, the orientation of the fins 50 and 52 and their geometric relationship with the hyperbolically curved side edge portions 22*b* and 24*b* of the tail section 28 provide enhanced surfboard performance.

Figure 4:
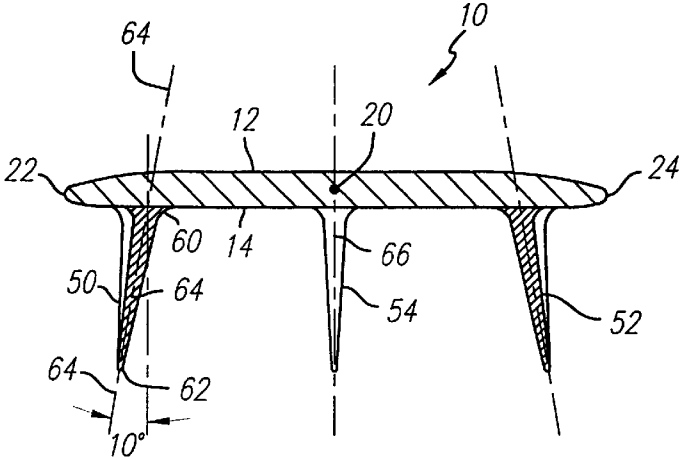
FIG. 4 is a transverse cross section of the surfboard of FIG. 1 as seen along the line 4—4 in FIG. 3.

Side fins 50 and 52 are identically configured and identically oriented relative to the x-, y- and z-axes, the z-axis, in accordance with conventional notation, being mutually orthogonal to the x- and y-axes. Using the side fin 50 as representative, this fin has a leading edge 56, a trailing edge 58, a base or root 60 along which the fin 50 is attached to the bottom surface 14 of the surfboard 10, and a tip 62 remote from the root 60. The leading edge 56 and the trailing edge 58 lie on a fin center plane 64. The center plane 64 of the fin 50 converges toward the nose 16 of the surfboard, that is, the leading edge 56 is closer to the longitudinal centerline than the trailing edge 58. The side fins 50 and 52 are thus toed in. At the same time, as shown in FIG. 4, the side fins 50 and 52 diverge in the z-axis direction, that is, they are tilted outboard. The tilt angle of each center plane may be, by way of example, 10°, and such tilting increases the stability of the board. Last, as seen in FIGS. 3 and 5, a rearward extension 64a of the center plane 64 of the side fin 50 passes through the focus 36 of the associated hyperbola 32. As already noted, the side fin 52 is the mirror image of the side fin 50 in both configuration and orientation. Preferably, each side fin 50, 52 should be so oriented that its center plane intersects, or nearly intersects, the focal point 36, 38 along the corresponding side of the board. However, in an alternative configuration, each side fin may also be oriented so that its center plane intersects the x-axis at a point outboard or inboard of the focal point along the corresponding side of the board. The third fin 54 is positioned closest to the tail 18 and is oriented so that its center plane 66 lies on the vertical y-z plane. In practice, the leading edge of the rear fin is preferably positioned forward of the focal points, that is, forward of the x-axis, as viewed in side elevation (FIG. 2). In addition, the rear edge of the rear fin is to the rear of the surfboard tail.

A surfboard incorporating the teachings of the present invention provides superior stability and maneuverability compared, for example, to known boards employing tail notches (which may be parabolic) centered on the board centerline or known boards employing tails with opposed edges disposed as a parabola centered on the board centerline, thus creating a single focus. The dual focal points of the present invention, one on each side of the tail section outboard of the narrowest portion of the tail section and lying on the center planes of the side fins, provides a substantial increase in leverage and hence stability and maneuverability as the rider leans from side to side to create turns. Additional advantages may be realized by making the thickness of the side fin cross sections at and adjacent the roots thereof greater than existing, relatively thin fin foils. Thicker side fins increase the acceleration of water directed to the foci of the hyperbolic tail section increasing thrust and maneuvering leverage.

It should be appreciated that the foregoing description is only illustrative of the invention. Various alternatives and modifications can be devised by those skilled in the art without departing from the spirit of the invention. Accordingly, the present invention is intended to embrace all such alternatives, modifications and variations as fall within the scope of the appended claims.

I claim:

1. A surfboard having a longitudinal centerline and opposed side edges disposed substantially symmetrically about said centerline, the surfboard including a tail section, the side edges of the surfboard along said tail section defining a generally hourglass configuration, the curvatures of the side edges along said tail section being substantially hyperbolic.

2. A surfboard, as defined in claim 1, in which the curvatures of the side edges of the tail section approximate the left- and right-hand branches of a hyperbola centered on an origin lying on said longitudinal centerline.

3. A surfboard, as defined in claim 2, in which the hyperbola is of the form $$y = \pm \frac{b}{a}\sqrt{x^2 - a^2}$$

in which:

x and y are the principal axes of said hyperbola;

a=the distance along the x-axis from the origin to the point at which the hyperbola intersects the x-axis; and b=the distance in a direction parallel to the y-axis from the point at which the hyperbola intersects the x-axis to an asymptote of the hyperbola.

4. A surfboard, as defined in claim 3, in which a is approximately equal to b.

5. A surfboard, as defined in claim 1, including a lower surface, the surfboard further including a pair of side fins projecting from the lower surface of said surfboard, the side fins being disposed symmetrically relative to said longitudinal centerline.

6. A surfboard, as defined in claim 5, in which each hyperbolic side edge has a focus and each of the side fins has a central plane oriented relative to the longitudinal centerline so that said center plane intersects the focus of the associated hyperbolic side edge.

7. A surfboard, as defined in claim 1, further including a tail, said tail extending generally transverse of said longitudinal centerline.

8. A surfboard having a longitudinal centerline and opposed side edges disposed substantially symmetrically about said centerline, the surfboard having a bottom surface and including a tail section, the side edges of the surfboard along said tail section defining a generally hourglass configuration, the curvature of each side edge along said tail section defining a focal point, the surfboard further including side fins projecting from the bottom surface of the surfboard, each side fin having a center plane disposed at an angle relative to the longitudinal center line of the surfboard, said angle being at least of a magnitude such that the center plane intersects the focal point.

9. A surfboard, as defined in claim 8, in which the side fins are toed-in relative to the longitudinal centerline of the surfboard.

10. A surfboard, as defined in claim 8, in which each side edge curve along said tail section is substantially hyperbolic.

11. A surfboard, as defined in claim 8, including a tail fin disposed along the longitudinal centerline of the surfboard.

12. A surfboard comprising:

a top surface, a bottom surface, a front end, a rear end, a tail section and a longitudinal center line extending from the front end to the rear end;

a pair of side fins projecting downwardly from the bottom surface of the surfboard, each side fin having a leading edge, a trailing edge, a center plane, a root along which the side fin is attached to the bottom surface of the surfboard and a tip distal from the root, the leading and trailing edges of each side fin lying on said center plane, one of the side fins being on one side of the longitudinal centerline and the other fin being on the other side of the longitudinal centerline, the side fins being disposed symmetrically of said centerline; and opposed side edges disposed symmetrically about said centerline, the side edges of the surfboard along said tail section defining a generally hourglass configuration, the curvatures of the side edges along said tail section being substantially hyperbolic, each hyperbolic side edge having a focus, the center plane of each side fin being oriented so as to approximately intersect the focus of the associated hyperbolic side edge.

13. A surfboard, as defined in claim 12, in which:

the center planes of the side fins diverge so that the roots of the side fins are closer to a vertical plane passing through the longitudinal centerline than the tips.

14. A surfboard, as defined in claim 12, including:

a tail fin projecting downwardly from the bottom surface of the surfboard, the tail fin being centered on the longitudinal centerline of the surfboard.

* * * * *